US005165800A

United States Patent [19]

Downey

[11] Patent Number: 5,165,800

[45] Date of Patent: Nov. 24, 1992

[54] PACKAGING APPARATUS

[76] Inventor: Elizabeth A. Downey, 323 13th Ave. E. #3, Seattle, Wash. 98102

[21] Appl. No.: 814,394

[22] Filed: Dec. 26, 1991

[51] Int. Cl.[5] ..... B65D 30/20

[52] U.S. Cl. ..... 383/78; 383/104; 383/120

[58] Field of Search ..... 383/78, 79, 80, 81, 383/82, 83, 84, 29, 120, 907, 104; 229/922

[56] References Cited

U.S. PATENT DOCUMENTS

| | | | |
|---|---|---|---|
| 2,259,192 | 10/1941 | Ames | 383/83 |
| 2,359,999 | 10/1944 | Langhofer | 383/907 X |
| 2,675,957 | 4/1954 | Zimmerman | 383/78 X |
| 2,721,023 | 10/1955 | Phipps | 383/78 X |
| 2,722,368 | 11/1955 | Gottsegen | 383/207 X |
| 3,484,037 | 12/1969 | Kugler | 383/21 |

FOREIGN PATENT DOCUMENTS

| | | | |
|---|---|---|---|
| 511103 | 10/1930 | Fed. Rep. of Germany | 383/78 |
| 1115256 | 4/1956 | France | 383/120 |
| 273414 | 5/1951 | Switzerland | 383/78 |
| 288492 | 4/1928 | United Kingdom | 383/79 |

*Primary Examiner*—Allan N. Shoap
*Assistant Examiner*—Jes F. Pascua
*Attorney, Agent, or Firm*—Robert W. Jenny

[57] ABSTRACT

The apparatus in its basic embodiment comprises a bag made of pliable material and a folded card attachable over the open end of the bag. In another embodiment, using a paper bag, the top edges of the sides of the bag are notched and the card is folded in three places such that it is M shaped in its end view. The card, attached to the top of the bag, can expand and contract with folding of the sides of the bag. The package formed by the apparatus can be colored, marked and shaped so that the package resembles an animal or the like and the apparatus may include one or more accessory pieces which enhance the resemblance and stabilize the package in a particular orientation. The packages may be equipped with handles by incorporating them into the cards or by placing loops of cord or the like between the closure component and the enclosure component.

2 Claims, 1 Drawing Sheet

FIG. 1
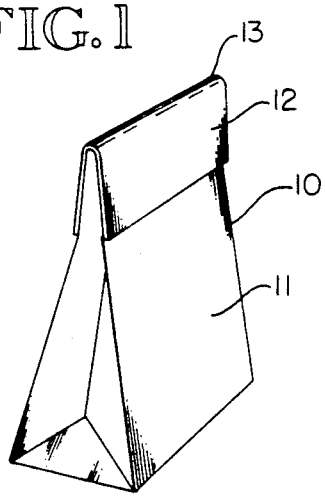
FIG. 2
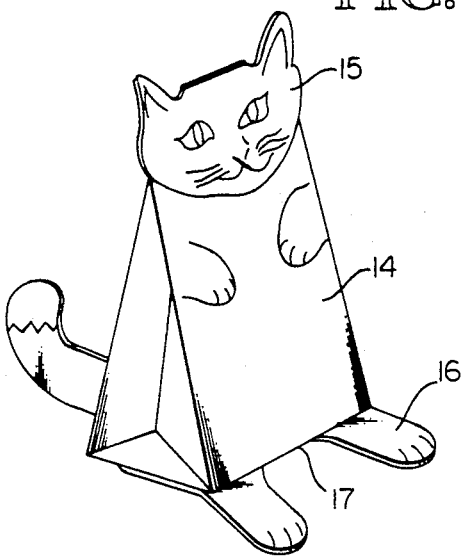
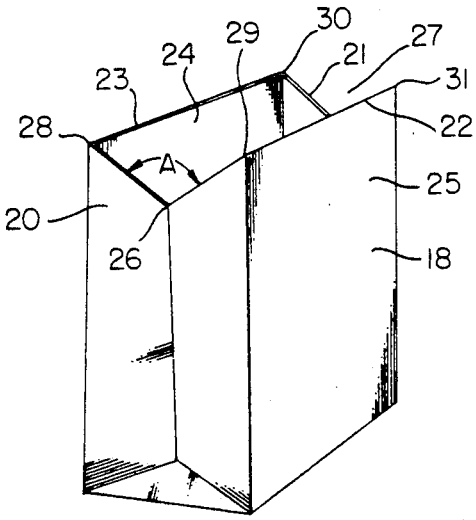
FIG. 3
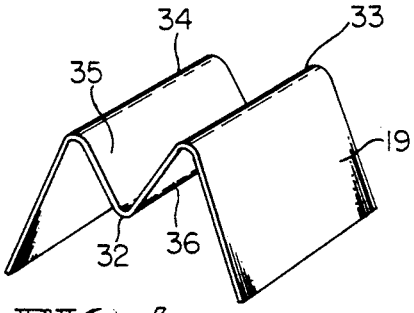
FIG. 4
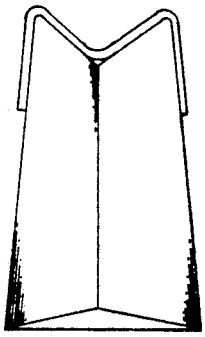
FIG. 5
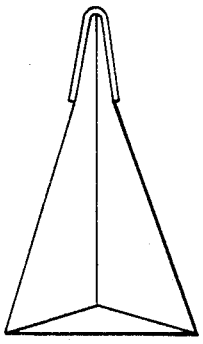
FIG. 6

PACKAGING APPARATUS

BACKGROUND OF THE INVENTION

1. Field

The subject invention is in various fields related to gift wrapping and packaging, including wrapping paper, bags, boxes and cards and notes attached to or printed on these items. More specifically it is in the field of packaging apparatus which combines a card and an article enclosure component such as a bag. Still more specifically it is in the field of such combinations in which the combination achieves an ornamental effect contributed to by all the components of the packaging apparatus. For purposes of this disclosure the terms packaging and wrapping are to be considered synonymous.

The invention also relates to the fields termed "cutouts" in which paper, cardboard and the like have pictures and other indicia printed on them and various components are cut out entirely or partially by hand or machine and folded and/or assembled using locking joints, adhesive, staples and the like to form representations of animals, buildings, people and the like. In some instances packaging may be produced with such cutout techniques.

2. PRIOR ART

There is much prior art in these fields, much of it not patented, much covered by design patents and some covered by utility patents. The closest prior art found in a preliminary search is U.S. Pat. No. Des. 305,728, which discloses packaging comprising a paper bag and a handle with decorative and informative indicia printed on the bag including some form of greeting. There is no prior art known to the subject inventor which combines an article enclosure and an enclosure closing component as well as a handle and at least one related accessory component to form a package having an integrated resemblance of an entity such as an animal, a vehicle, a person, a building and the like. The primary objective of the subject invention is to provide such a combination in the form of gift packing apparatus. Other objectives are that the apparatus be economical to manufacture, easy to use and ornamentally interesting.

SUMMARY OF THE INVENTION

The subject invention is packaging apparatus which basically comprises an enclosure and a closing component and may also comprise a handle and one or more components attachable for functional, stuctural and/or ornamental purposes.

In a preferred embodiment the enclosure is a paper bag and the closure component is a folded, stiff paper card. Two forms of closure can be used with this embodiment. In one embodiment the bag is closed at the top by folding the center of the sides inward in the well known fashion and placing the card over the bag with the fold against the top edges of the bag and held in place by double-back tape, a staple, a clip or the like. In a second form the sides of the bag are notched from the corners of the opening of the bag to the folds at the centers of the sides, the enclosed angles of the notches being approximately 90 degrees and the card has a center fold which is close to the bottoms of the notches when the bag is closed and two side folds, one along each of the edges of the faces of the bag. With the bag upright, the center fold is upward and the outer folds are downward, giving the card an M shape in its end view. The card is also attached to the bag by tape, a staple, a clip or the like.

In one ornamental version of the invention indicia are printed on the bag to make it resemble the body of a cat and indicia printed on the card and the shape of the card make it resemble the head of the cat. The structural, functional and ornamental aspects of the invention can be enhanced by adding an auxilliary card. In the example of the embodiment resembling a cat the auxilliary card is shaped and marked to resemble a cat's hind paws and its tail and it is attached to the bottom of the bag. The extension of the paws from one side of the bottom of the bag and the tail from the other renders the bag much more stable when it is standing on its bottom. A handle for carrying the package formed by the bag and card, and accessory card if used, can be added in any of various ways, generally well known in the art. Also the card may be designed as a greeting card, with or without spaces designated for handwritten messages and signatures.

The invention is described in more detail below with reference to the attached drawings.

BRIEF DESCRIPTION OF THE DRAWINGS

FIG. 1 is a perspective view of the subject invention in its basic form.

FIG. 2 is a perspective view of the subject invention configured to resemble a cat.

FIG. 3 is a perspective view of a bag modified to accept a triple fold closure card.

FIG. 4 is a perspective view of a triple fold closure card.

FIG. 5 is a side view of a package incorporating the bag of FIG. 3 and card of FIG. 4.

FIG. 6 is a side view of a package incorporating a single fold card.

DETAILED DESCRIPTION OF THE INVENTION

The subject invention is gift packaging apparatus and a basic embodiment 10 of the invention is shown in FIG. 1. It comprises a paper bag 11 and a card 12 folded at 13. The card is attached by double-backed tape, not visible in this view, to hold the bag closed. A more elaborate embodiment of the invention is shown in FIG. 2 in which the bag 14 is marked and the card 15 is shaped and marked so that the package resembles a cat. Card 16 is an accessory attached to bottom 17 of the bag by tape or the like to enhance the resemblance and to enhance the stability of the package. For purposes of this disclosure bottom 17 is termed the second end of the bag, i.e. enclosure component, of the apparatus.

FIG. 3 illustrates a bag 18 which is modified to use a triple folded card 19 as shown in FIG. 4. Sides 20 and 21 of the bag are notched from top edges 22 and 23 of faces 24 and 25 to the centers 26 and 27 of each side, center 27 not being visible in this view. There are four junctures of the two sides with the two faces, 28, 29, 30 and 31. Angle A of the notches is in the range of 40 degrees to 110 degrees with 90 degrees preferred. Card 19 has a center and two side folds, 32, 33 and 34, fold 32 being upward relative to the bag and folds 33 and 34 downward. Portions 35 and 36 of this card are dimensioned to match the notch contours on the bag. The notching of the bag, in combination with the triple fold card, increases the usable capacity of a given size of bag. This difference in capacity is illustrated in FIGS. 5 and 6, side views of a package using a three fold card and one with the single fold card respectively. Handles can be provided by making appropriate cutouts in the cards or by placing a loop of cord, ribbon or the like between the card and the bag. The notched end of the bag is termed its first end for purposes of this disclosure.

It is considered to be understandable from this description that the subject invention meets its objectives. It provides packaging which comprises an enclosure and a closing component and may also comprise a handle and an accessory component. The package is economical to manufacture, easy to use and is ornamentally interesting.

It is also considered to be understood that while certain embodiments of the invention are described herein, other embodiments and modifications of those described are possible within the scope of the invention which is limited only by the attached claims.

I claim:

1. Packaging apparatus comprising an enclosure component made of pliable material and a closure component, said enclosure component having first and second ends, first and second faces and first and second sides, said first end being open and each of said sides having a fold and being foldable to allow closing of said first end and further comprising edges of said sides and faces around said first end, said sides having junctures with said faces and each of said sides having a notch, said notch extending from one of said junctures of each of said sides with said first face to said fold in said side to a second of said junctures of each of said sides with said second face, said closure component being a foldable card having a center fold and first and second side folds such that in end view it resembles the letter M, said apparatus futher comprising means for fastening said closure component to said enclosure component, said closure component being attachable to said enclosure component with said center fold in said notches and said first and second side folds contacting said edges of said faces.

2. The packaging apparatus of claim 1 further comprising a card attached to said second end, said card having portions which extend beyond said second end.

* * * * *